United States Patent [19]

Melillo et al.

[11] Patent Number: 4,515,361

[45] Date of Patent: May 7, 1985

[54] EXERCISING APPLIANCE

[75] Inventors: Anthony Melillo, Bernardsville; Louis Gabriele, Livingston, both of N.J.

[73] Assignee: Michael Codella, Parsippany, N.J. ; a part interest

[21] Appl. No.: 463,992

[22] Filed: Feb. 4, 1983

[51] Int. Cl.[3] ..... A63B 23/02

[52] U.S. Cl. ..... 272/93; 272/900; 272/145

[58] Field of Search ..... 272/93, 145, 900

[56] References Cited

U.S. PATENT DOCUMENTS

| | | | |
|---|---|---|---|
| 1,705,745 | 3/1929 | Anderson | 272/145 |
| 3,134,592 | 5/1964 | Sharkey | 272/900 X |
| 4,422,635 | 12/1983 | Herod | 272/900 |

*Primary Examiner*—Richard J. Johnson

*Attorney, Agent, or Firm*—Sherman & Shalloway

[57] ABSTRACT

A device is disclosed which may be used by a person in the performance of a variety of exercises. The device includes in a preferred embodiment two substantially rectangular members pivotally joined together at respective ends thereof. One of these members is designed to be placed under a mattress so as to be retained thereunder by frictional forces as well as by the weight of the mattress. The other member includes an adjustable bar which may be gripped by the hands or restrain the feet of the user in the performance of various exercises and further includes structure for displaying a variety of information. When the device is being used for exercising, the two members are pivoted to form about a 90° angle with one another and are retained in the position by retaining means. The members may be pivoted to a position adjacent one another and locked in this position for easy transport.

20 Claims, 13 Drawing Figures

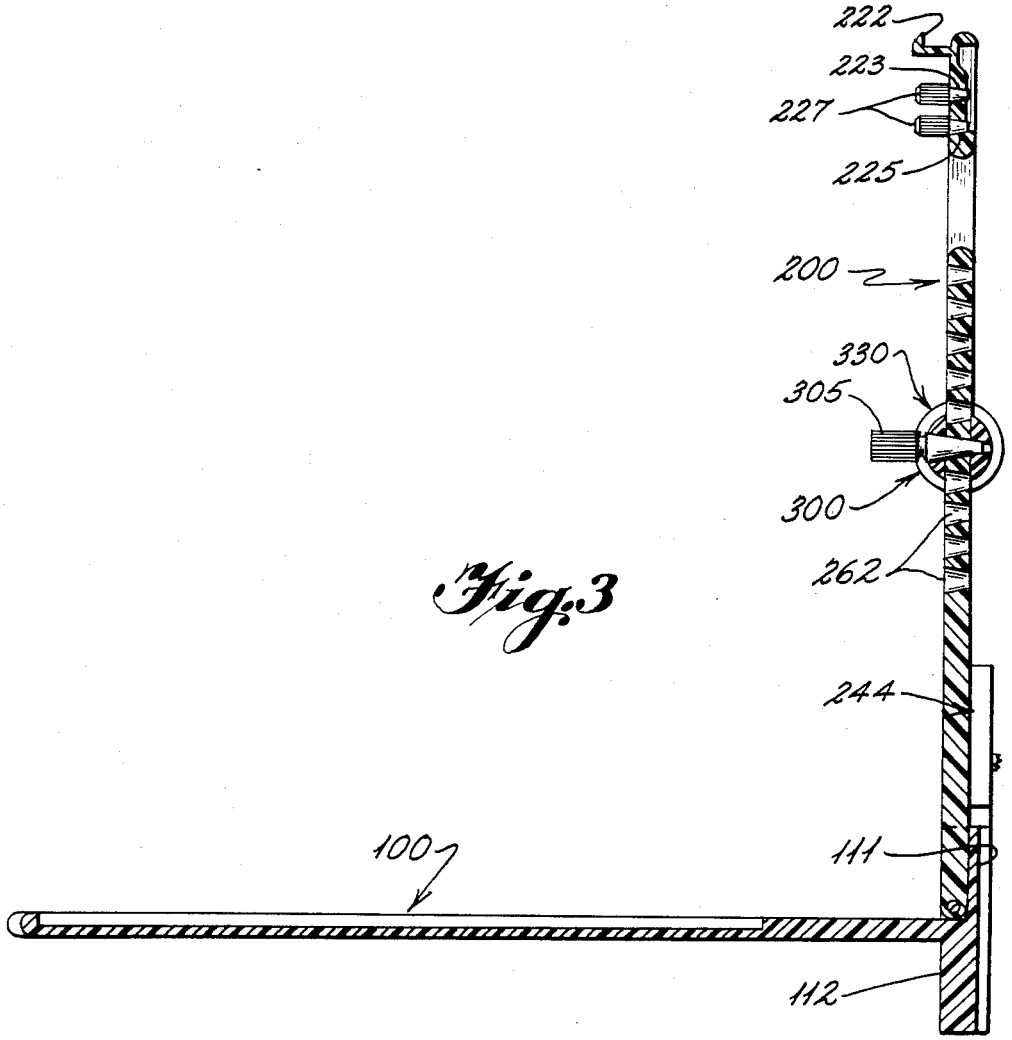
Fig. 3
Fig. 5
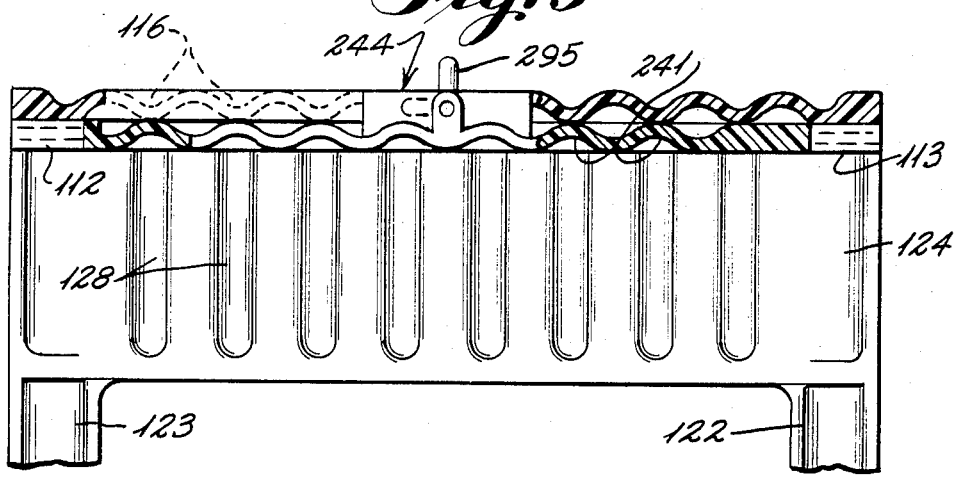

125
127
222
200
100
100
244
110
100

EXERCISING APPLIANCE

BACKGROUND OF THE INVENTION

Devices designed to assist a person in performing exercises are well known. U.S. Pat. No. 1,953,857 to Hunter generally shows the combination of a foot holding device mounted on the support. U.S. Pat. No. 2,759,730 to Berry shows an exercising device which includes structure 30, 31 which could be construed as a support. U.S. Pat. Nos. 3,134,592 to Sharkey and 3,787,048 to Bock disclose devices for assisting a user in performing sit-ups in which the structure for supporting the feet is adjustable in height. U.S. Pat. No. 3,826,490 to Mossman discloses exercising equipment which includes a member 66 placed between the mattress and box spring for support. U.S. Pat. No. 4,182,509 shows a sit-up device including a base portion and footholding member, the device appearing to be intended to be placed under a door for support.

While some of these patents appear to show, in a quite general way, some of the features of the instant invention, none shows structure which comprises an entity with all of the features of the exercising apparatus disclosed herein.

SUMMARY OF THE INVENTION

Accordingly, it is an object of the present invention to provide an exercising appliance that is lightweight, portable, and which may include integral handle means for easy transport.

It is a further object of the present invention to provide an exercising applicance which, in a preferred embodiment, may have a portion thereof placed between a mattress and box spring or under a mattress to retain the applicance in a fixed location.

It is a still further object of the present invention to provide an exercising applicance including an adjustable bar which may be gripped by a person's hands or which may restrain a person's feet to enable exercises to be performed.

It is yet a further object of the present invention to provide an exercising appliance which includes indicating means which may indicate days, weeks, months, and/or years and may further indicate numerals corresponding to repetitions of various exercises.

These and other objects, advantages, features and aspects of the invention will become apparent upon reading the following detailed description of a preferred embodiment and upon reference to the accompanying drawings.

BRIEF DESCRIPTION OF THE DRAWINGS

FIG. 3 shows a sectional view taken along the line 3—3 of FIG. 1.

FIG. 5 shows a sectional view taken along the line 5—5 of FIG. 1.

DESCRIPTION OF THE PREFERRED EMBODIMENT

Figure 1:
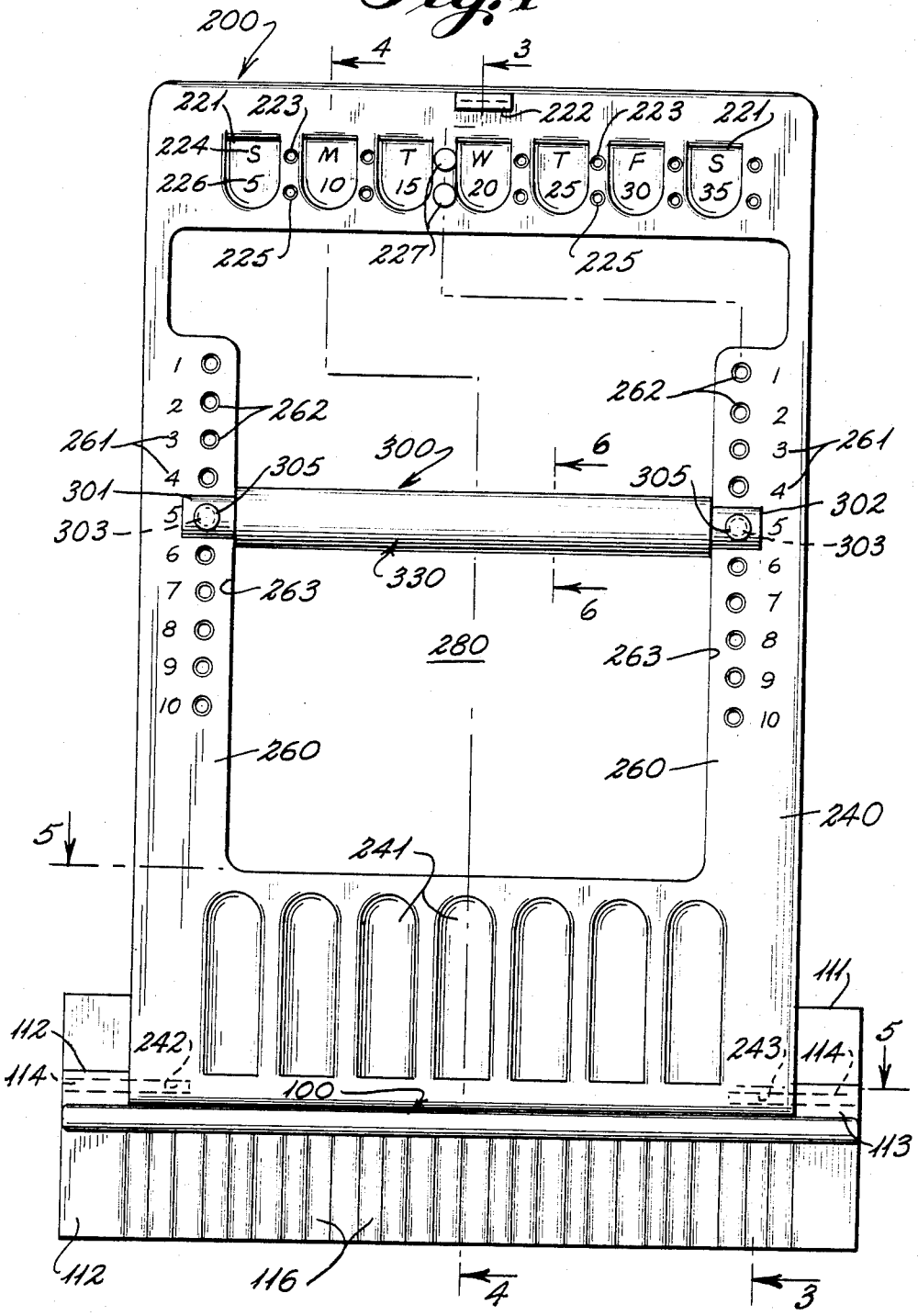
FIG. 1 shows a front elevation view of the preferred embodiment of the invention secured in the open position.

Referring to FIGS. 1–12, a device is shown which may be used to allow a person to perform a variety of exercises. FIGS. 1–3 and 12 in particular show the device locked in the open position by retaining means disclosed hereinafter. In the position shown, portion 100 is placed under a bed mattress 400 or between the mattress 400 and box springs 500 thereof (see FIGS. 11–12) so as to be fixed in position. Upstanding portion 200 extends upward from one edge of the mattress. Retaining bar 300 is adjusted to the desired height and fixed in position by retaining means and subsequently the desired exercises are performed.

Figure 2:
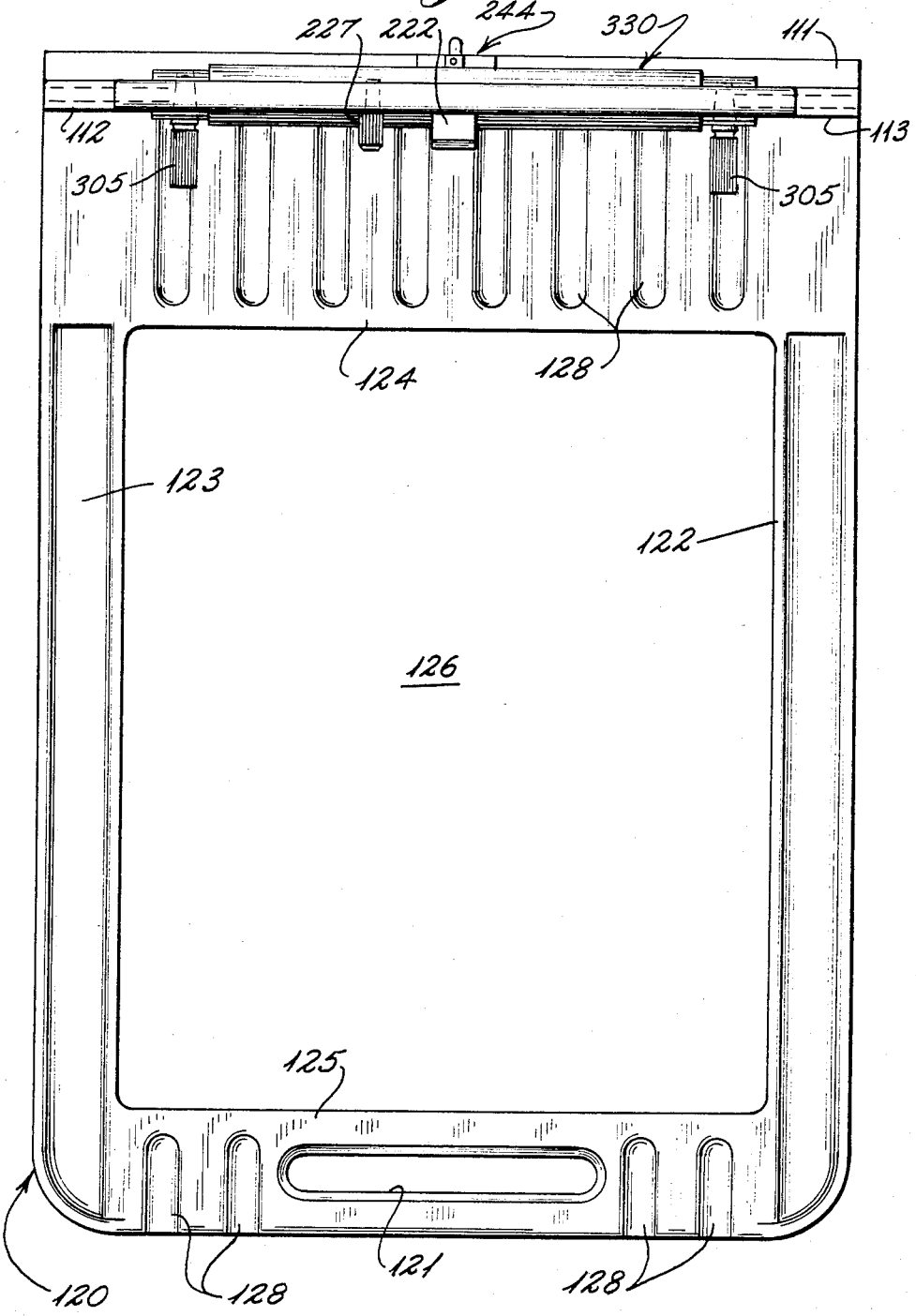
FIG. 2 shows a top plan view of the embodiment of FIG. 1.
Figure 8:
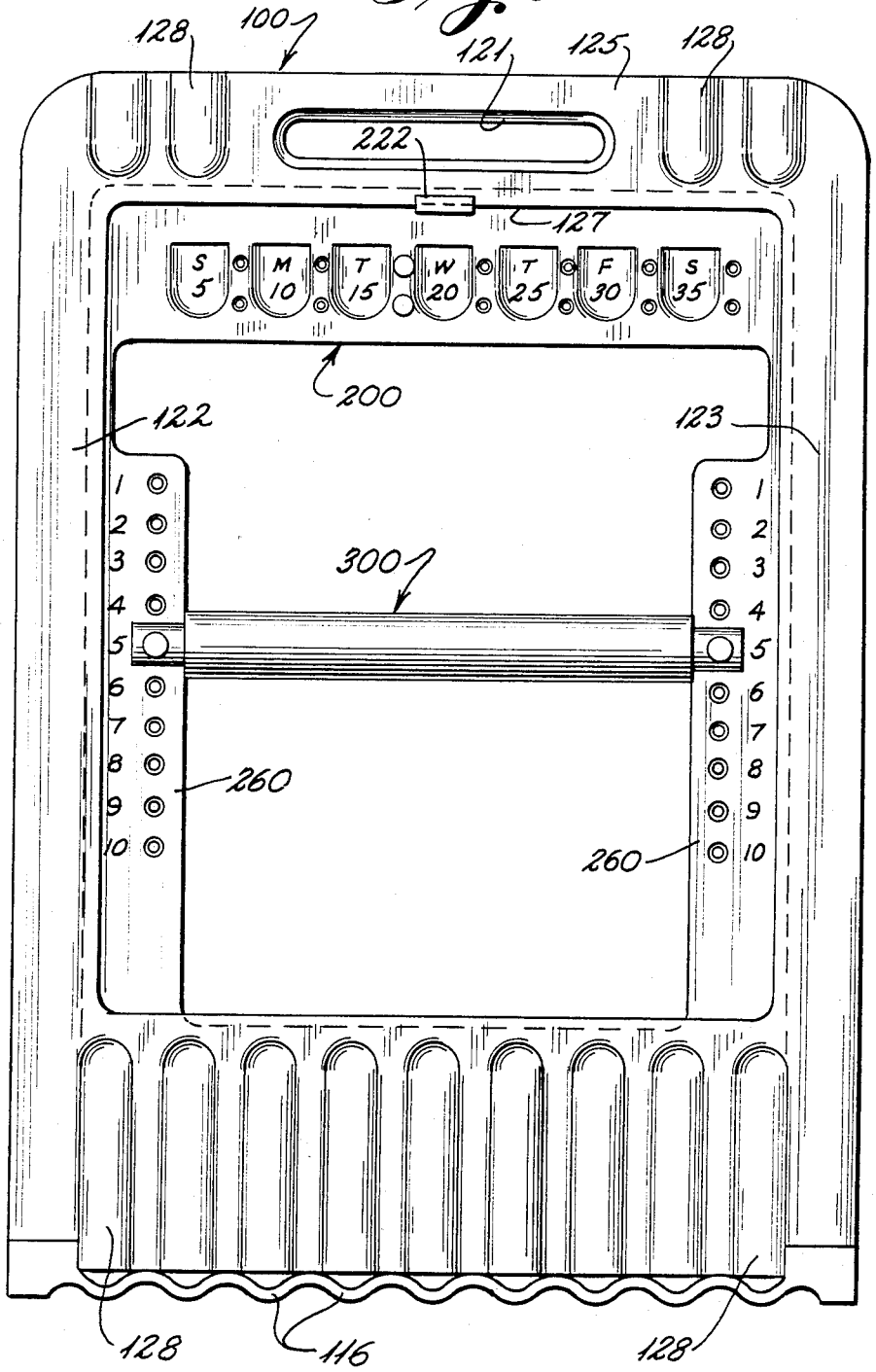
FIG. 8 shows a front elevation view of the embodiment of FIG. 1 secured in the closed position.

Referring now to FIGS. 1–2 and 8 in particular, a specific description of the portion 100 will be given. Portion 100 is made in a generally rectangular shape and includes a base portion 110 and a portion 120 extending vertically therefrom. Base portion 110 includes a relatively thin portion 111, a relatively thick portion 112 and portions 113 with holes 114 for a purpose explained hereinafter. Portion 111 includes a boss 115 also for a purpose explained hereinafter. Vertical portion 120 includes a slot 121 which serves as a handle and is designed to receive the fingers of the hand of the person transporting it. Upstanding portion further includes leg portions 122, 123, bottom portion 124 and upper portion 125. The upper, bottom and leg portions define an opening 126 which allows the mattress to bow into the portion 100 to aid in retaining the device in position. Upper portion 125, in addition to including the slot 121, includes a lower lip 127 for a purpose to be described hereinafter.

As best shown in FIG. 8, the base portion as well as the vertical portion are corrugated substantially throughout, the vertical portion 120 having corrugations 128 and the base portion 110 having corrugations 116. The corrugations are included in the design of the various components of the device for four main reasons: (1) the corrugations make the device lighter and more easily transportable: (2) the corrugations prevent warping of the device during and after the molding procedure; (3) the corrugations on the upstanding portion 120 are specifically included to enhance the retention of the device under the mattress through creation of frictional forces; (4) the corrugations spread stress forces throughout the components and thus allow greater forces to be exerted.

Figure 9:
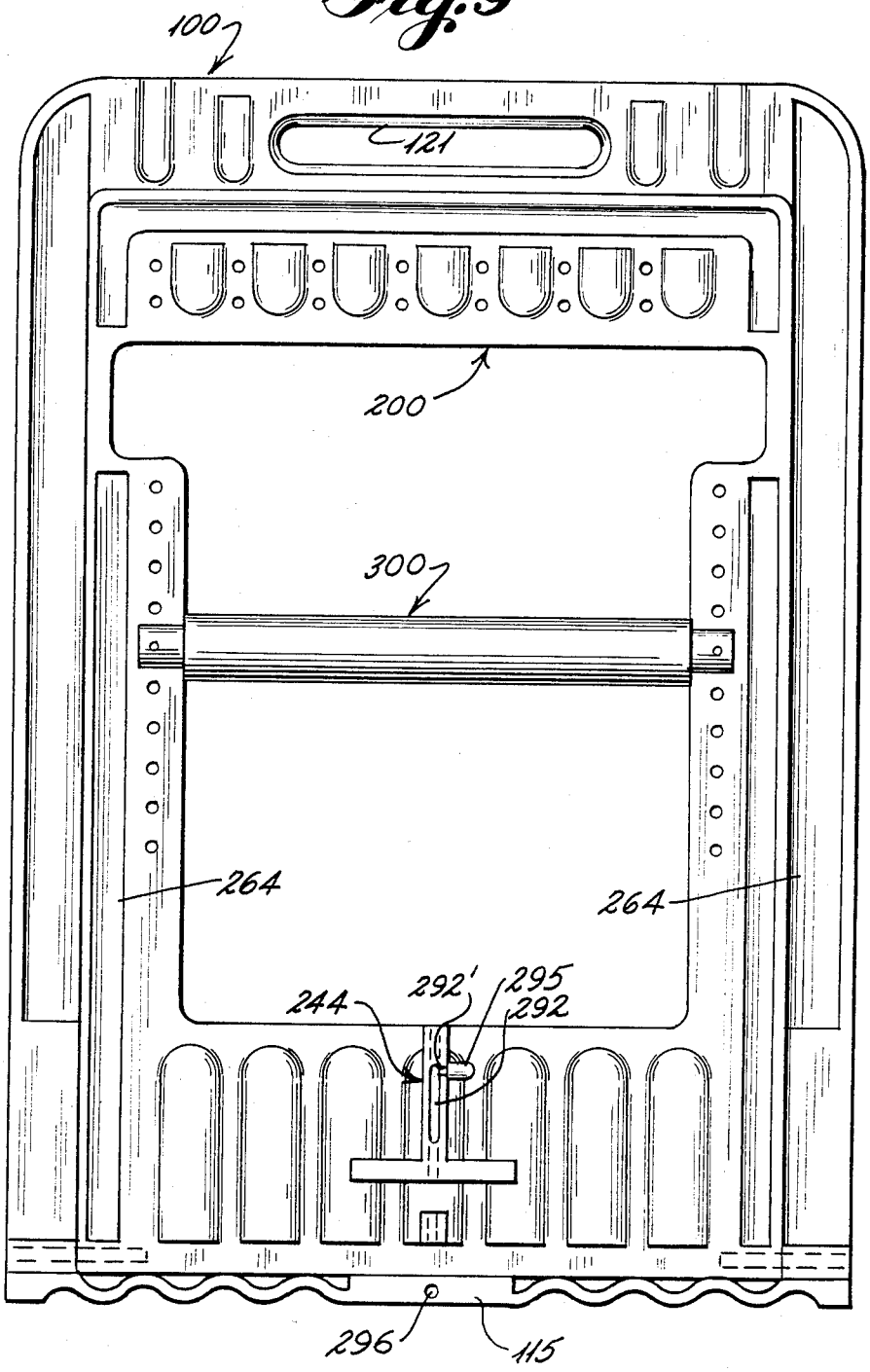
FIG. 9 shows a back elevation view of the embodiment of FIG. 1 secured in the closed position.
Figure 10:
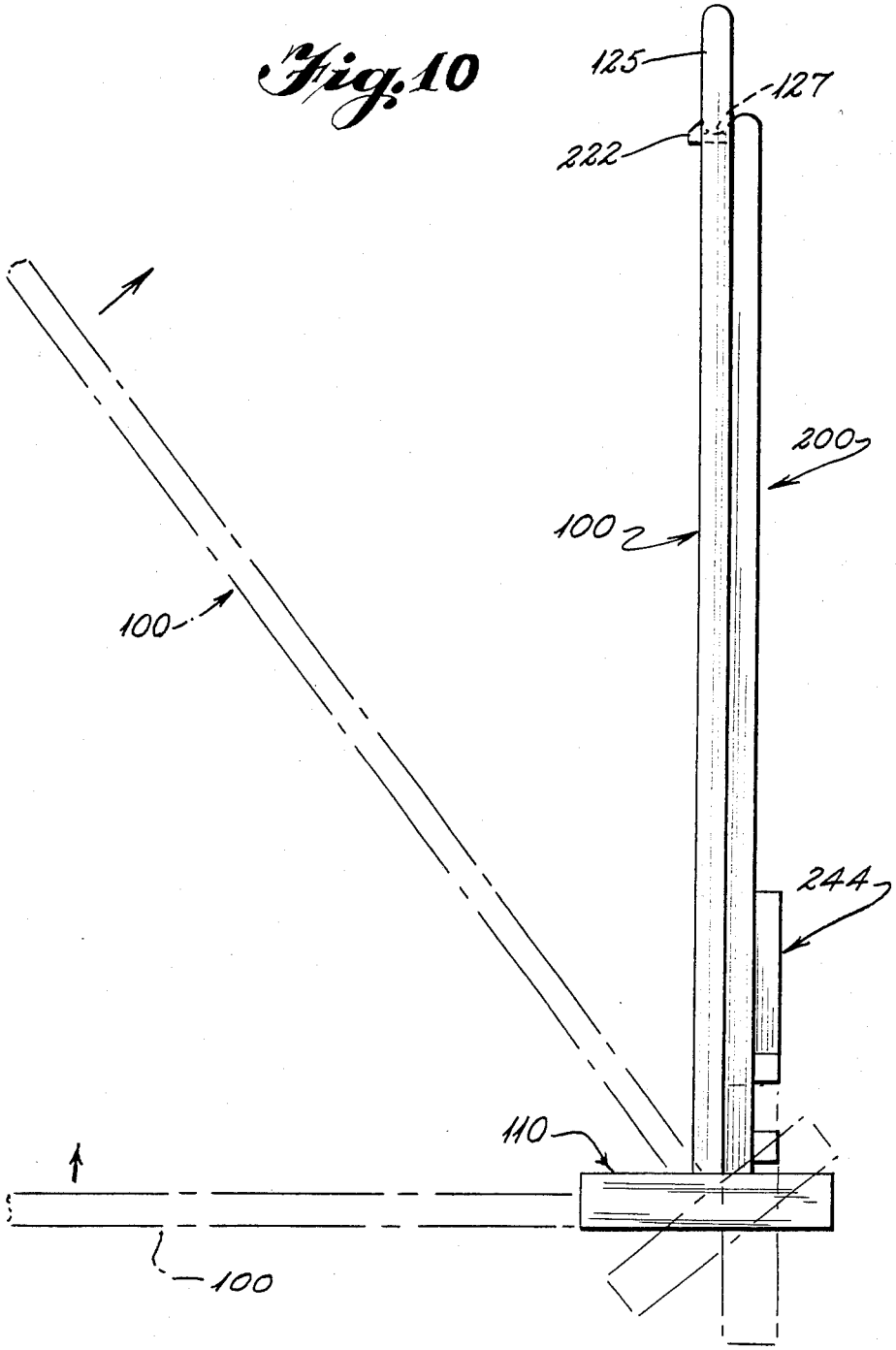
FIG. 10 shows a side elevation view of the embodiment of FIG. 1.
Figure 11:
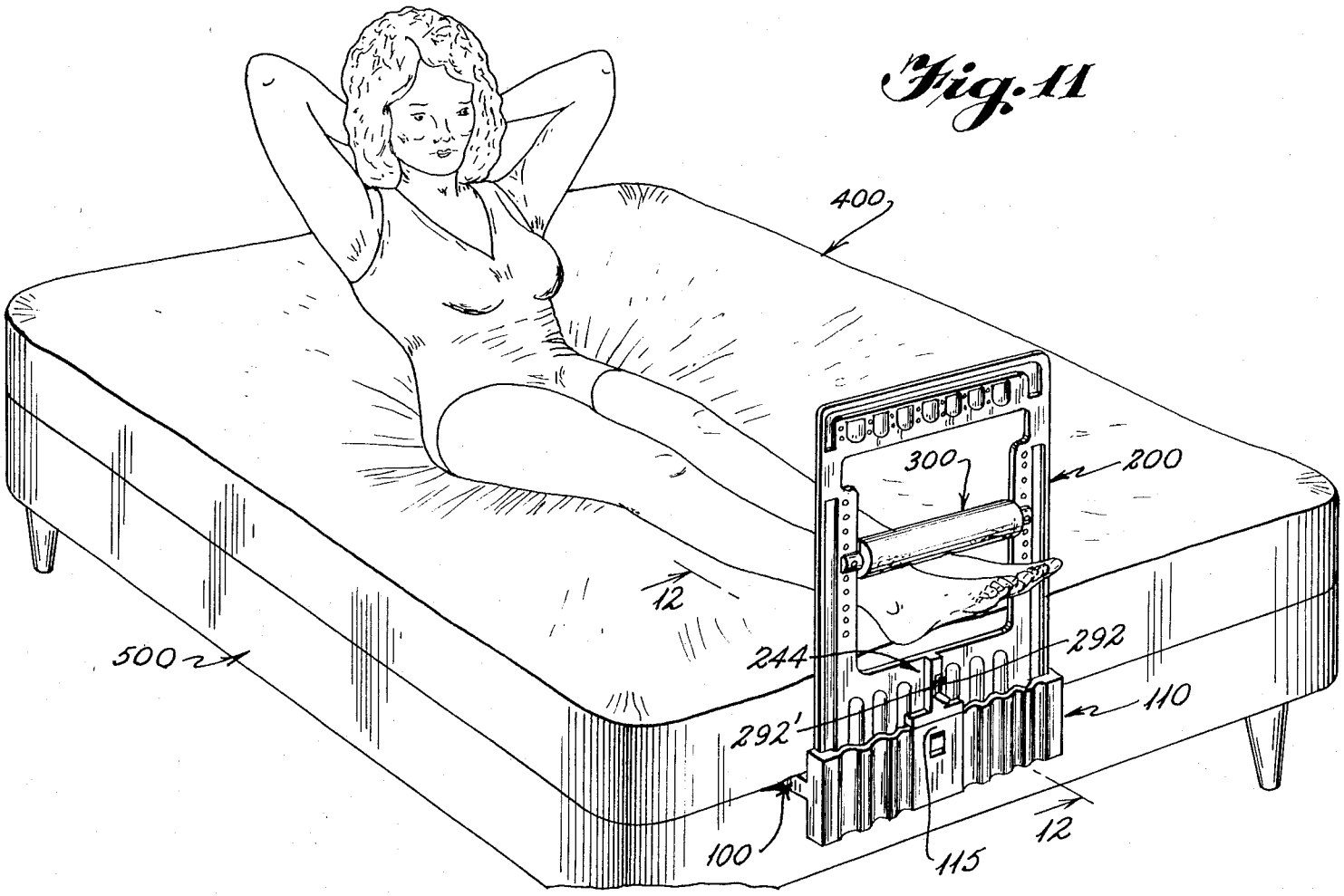
FIG. 11 shows a perspective view of the embodiment of FIG. 1 placed between the bed mattress and box spring and shown in one use thereof.

Referring now to FIGS. 1 and 9 in particular, the details of upstanding portion 200 will be described. As shown therein, a portion 200 includes upper portion 220, lower portion 240 and side legs 260 which surround opening 280. Upper pportion 220 has indentations 221 as shown in FIG. 9 and includes single-pronged retention means 222 on the front portion thereof as best seen in FIG. 3. The upper portion 220 also includes two rows of holes 223, 225 and corresponding rows of indicia 224, 226 located within indentations 221. These holes, as shown in FIG. 3 are tapered and are designed to receive tapered locating pins 227 in a frictional fit as is well known. The purpose of these holes and indicia is so that the user may place locating pins in the appropriate holes to give an indication of, for example, days of the week on which exercises will be undertaken and how many repetitions of these exercises will be performed. Obviously, any indicia desired may be used to mark the various holes. Side legs 260 include indicia 261, holes 262 and guide means 263 for the retaining bar 300 best shown in FIGS. 1, 3 and 6–9. Holes 262 are evenly spaced apart and the indicia may indicate distances in inches, centimeters, etc. As best shown in FIG. 3, holes 262 are tapered and designed to receive tapered locating pins 305 which serve to hold retaining bar 300 in the desired fixed position. Referring to FIG. 1, indicia 261 are located on the front portion of legs 260 opposite channel-like portions 264 shown in FIG. 9. Guide means 263 are formed with a substantially semi-circular cross section which facilitates ease in adjustment of retaining bar 300.

As shown in FIG. 1, lower portion 240 has corrugations 241 and further includes holes 242, 243. On the back of lower portion 240 (FIGS. 2 and 9) is located a retaining means 244 to be described hereinafter.

Figures 4, 6, 7:
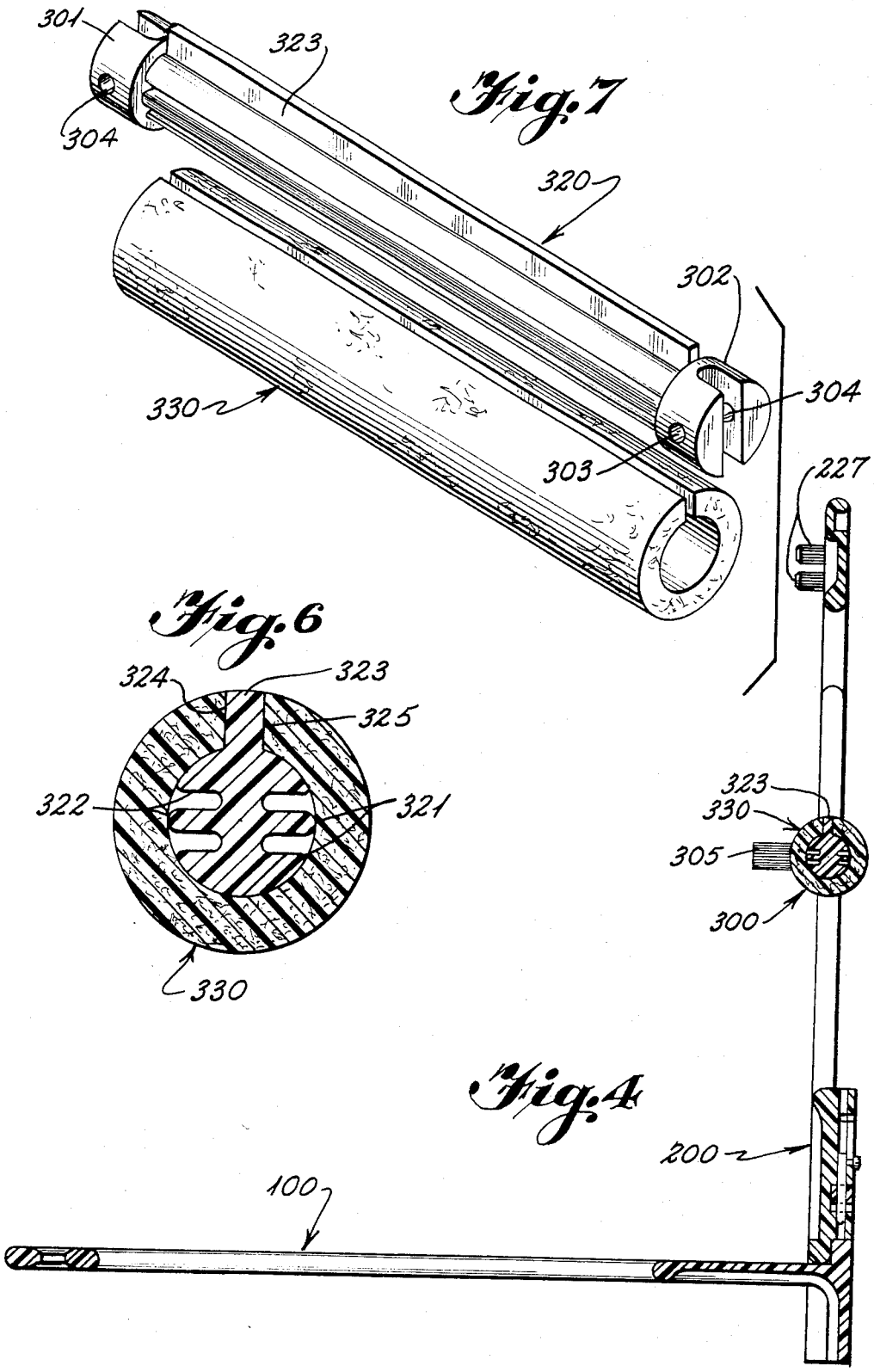
FIG. 4 shows a sectional view taken along the line 4—4 of FIG. 1.
FIG. 6 shows a sectional view of the retaining bar taken along the line 6—6 of FIG. 1.
FIG. 7 shows an exploded perspective view of the retaining bar.

Referring now to FIGS. 6–7 in particular, retaining bar 300 is shown to include slotted end portions 301, 302, holes therein 303, 304, and a long central portion 320. As shown in FIG. 6, the cross section of central portion 320 includes ribs 321, 322 which facilitate the molding process and key member 323. A resilient cover member 300 is stretched over central portion 320 and the ends thereof may abut opposed sides 324, 325 of key member 323.

The retaining bar is installed on upstanding member 200 with slotted end portions 301, 302 embracing guide means 263. Holes 303, 304 are lined up with holes 262 and a locating pin 305 is inserted through each set of holes 303, holes 262 and then holes 304 to retain the retaining bar in a fixed position. If it is desired to change the position of the bar, locating pins are removed and the bar is moved to the desired position with the pins then replaced into their respective holes.

The upstanding portion 200 is mounted to portion 100 by simply lining up holes 242, 243 with holes 114, 114 and inserting a pin through each set of lined up holes to form a pair of hinges which pivotally connect portions 100, 200 together. When it is desired that the device be transported, the portions 100, 200 are merely pivoted to a flat configuration with single-pronged retainer 222 engaging lip 127 to retain the device in this configuration. To unlock retainer 222, one merely must resiliently press the prong from the back of portion 100 through which it protrudes and then separate the portions 100 and 200. When it is desired to exercise, retainer 222 is unlocked and portion 200 is pivoted until retainer 244 locks with boss 115.

Figure 12:
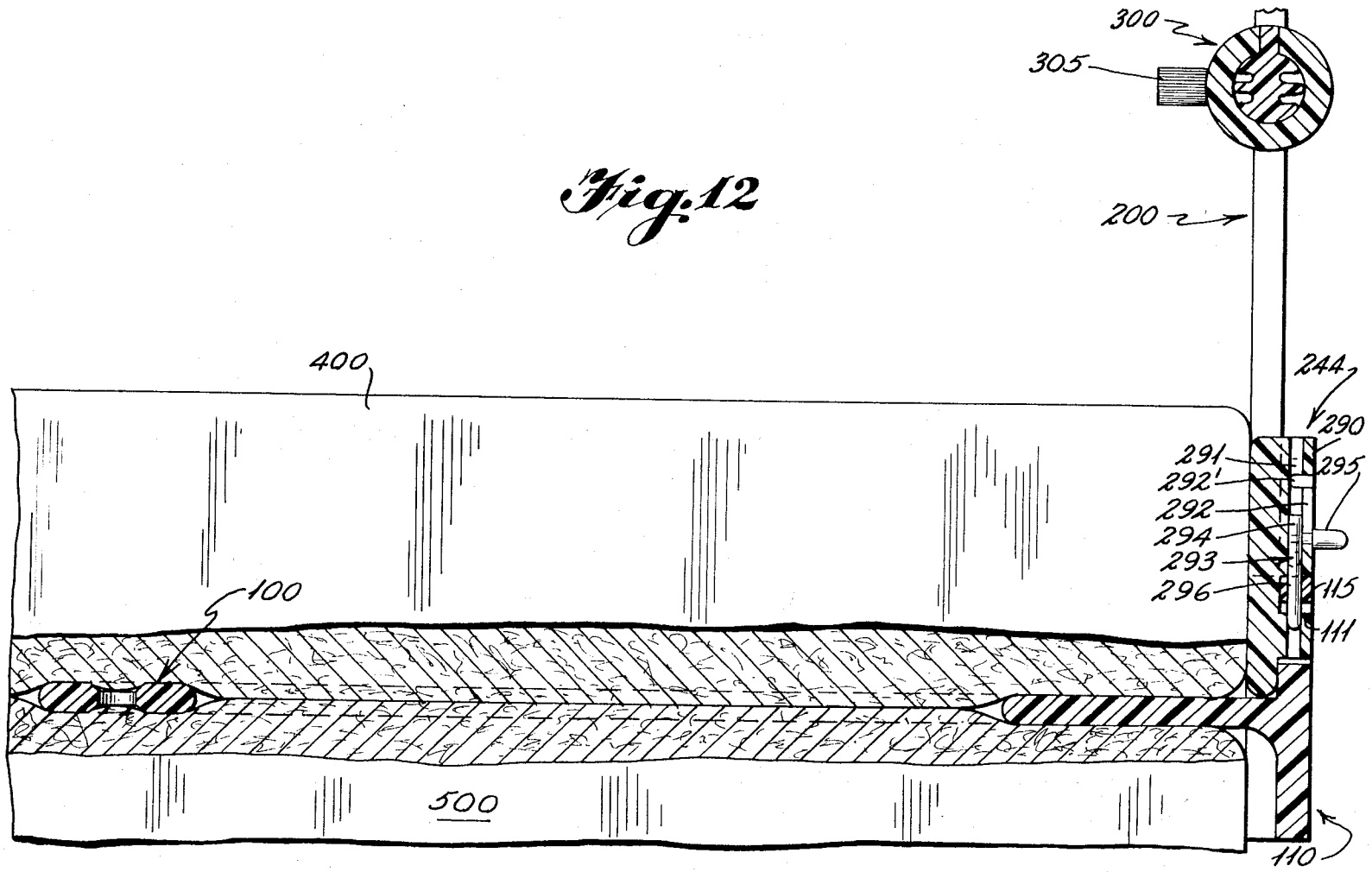
FIG. 12 shows a sectional view taken along the line 12—12 of FIG. 11.

Referring now, in particular, to FIGS. 9 and 12, the retention means 244 includes a T-shaped protrusion 290 formed on the back of lower portion 240. Protrusion 290 includes a hole 291 and an L-shaped slot 292, 292'. A rigid pin means 293 preferably made of steel including pin portion 294 and handle portion 295 is placed in hole 291 with handle portion 295 oriented in slot 292, 292' so as to allow rotation and subsequent reciprocation of the pin 293. Boss 115 on portion 111 of base portion 110 also has a hole 296 preferably of the same diameter as hole 291. In the upper position of pin 293, handle portion 295 is located in horizontal slot 292' to prevent reciprocation thereof. In operation, when it is desired to lock portions 100 and 200 in substantially a right angle orientation, first, retainer 222 is released as explained above, then portion 200 is pivoted with respect to portion 100 until the back of lower portion 240 abuts with portion 111 and boss 115 and T-shaped protrusion 290 are aligned to thereby axially align holes 291 and 296. Now pin handle portion 295 is pivoted in slot 292' until it is aligned with slot 292 whereupon the pin 293 is reciprocated so that pin portion 294 traverses hole 291 and enters axially aligned hole 296 to thereby rigidly lock the portions 100 and 200 in position. To fold up the device, the above steps are reversed, culminating in re-fastening of retainer 222.

The material used to manufacture portions 100, 200 and 300 may be any suitable material, for example, high impact styrene plastic. Any material having durability, shatter resistance and low weight would be suitable. Resilient cover member 330 may be made of any soft, flexible material. For example, polyurethane and polypropylene have been found to be suitable. Portions 100, 200, 300 may be made of wood, aluminum, fiberglass, etc., as well as plastic. In the preferred embodiment portions 100, 200, 300 are made of styrene in an injection molding process whereas cover 330 is made of polyurethane.

The portion 100 is designed to be sufficiently long so that the desired leverage to retain the device in place is achieved. Experiments have led to the conclusion that the optimum length for portion 100 is about 20–22 inches. The opening 126 must be sufficiently large so as to (1) prevent warping of the portion 100 and (2) enhance the retention forces acting thereon when installed under a mattress.

Figure 13:
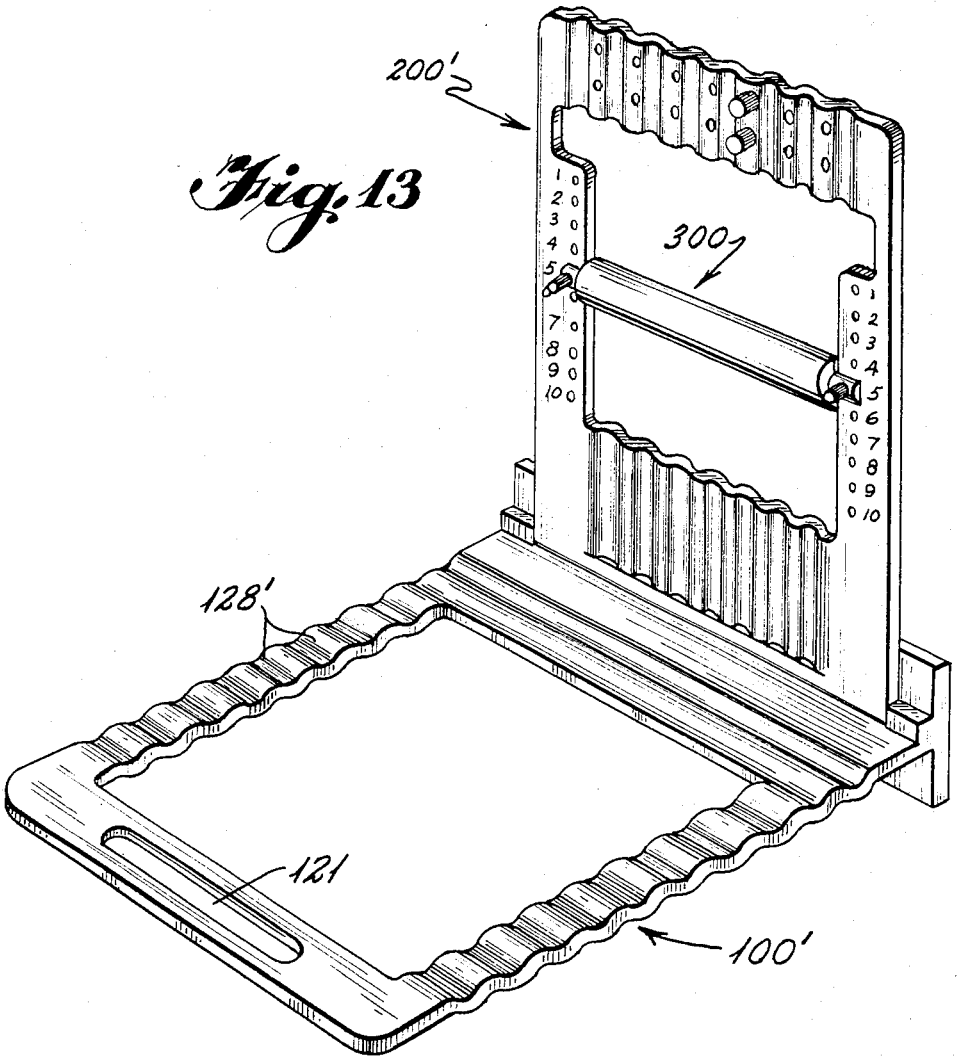
FIG. 13 shows a perspective view of a second embodiment of the invention.

FIG. 13 shows an alternative embodiment of the invention. In this embodiment, the major difference from the embodiment of FIGS. 1–12 is in the specific structure of the corrugations. As is clearly seen, the corrugations 128' of portion 100' run horizontally instead of vertically. It is clearly within the purview of this invention that the corrugations thereof may be oriented in any desired direction.

The upstanding portion is made sufficiently lengthly to accommodate to differing thicknesses in mattresses and to provide sufficient adjustability of retaining bar 300. The width thereof is also designed so as to accommodate differing leg thicknesses.

The types of exercises which may be performed with this invention are limited only by the user's imagination. Examples of exercises: (1) sit-ups by hooking the feet under the bar; (2) leg lifts by lying on one's back and grasping the bar by raising the arms over the head; (3) squats by standing on the floor adjacent the bed, and grasping the bar with the hands; (4) retaining a single foot under the bar while lifting the other leg.

Thus, it is apparent that there has been provided in accordance with the invention of a unique exercising appliance that fully satisfies the above mentioned objects. While the invention has been described with reference to a single embodiment, the invention is intended to embrace all alternatives, modifications and variations which will be apparent to those skilled in the art in view of the foregoing description and should only be construed as limited by the following claims.

We claim:

1. An exercising appliance comprising a first generally planar portion and a second generally planar portion, said first and second portions being pivotally connected to one another at a pivot axis located at respective ends of said portions, said first portion including:

(a) a first means adapted to assist in frictionally retaining said first portion in a substantially fixed position when said first portion is placed in a confined space;

(b) stop means adjacent said pivotally connected end for limiting the movement of said first portion into said confined space to a pre-determined distance; and (c) slot means formed at an end opposite said pivotally connected end which forms handle means;

said second portion including (a) guide means on opposed sides thereof;

(b) spaced retention means formed adjacent each guide means, and (c) bar means mounted on said second portion including:

(i) second means interengaging with said guide means to allow slidable movement of said bar means on said guide means with respect to the pivot axis; and (ii) third means in each said second means, said third means adapted to be aligned with said spaced retention means at pre-determined positions of movement of said bar means; and (iii) locating means adapted to interengage with said spaced retention means and said third means to lock said bar means into pre-determined fixed positions.

2. The exercising appliance of claim 1, wherein said stop means limits pivotal movement of said first and second portions with respect to one another to an angular displacement therebetween of approximately 90°.

3. The exercising appliance of claim 2 wherein said stop means further includes boss means and said second portion further includes protrusion means which aligns with said boss means when said first and second portions are displaced at approximately 90° apart and further including interengaging means carried by one of said boss means and said protrusion means which is operative to releasably retain said first and second portions at said displacement of approximately 90°.

4. The exercising appliance of claim 3 wherein said interengaging means comprises pin means carried by said protrusion means, and said boss means and said protrusion means each having a hole into which said pin means enters to releasably retain said first and second portions.

5. The exercising appliance of claim 3, wherein said first portion further includes a further slot means and said second portion further includes projection means, said projection means interengaging with said further slot means when said first and second portions are pivoted to a substantially parallel configuration to thereby releasably retain said first and second portions in said substantially parallel configuration.

6. The exercising appliance of claim 5, wherein said protrusion means and said projection means are located on opposite faces of said second portion.

7. The exercising appliance of claim 1, wherein said first means includes corrugations formed thereon.

8. The exercising appliance of claim 7, wherein said corrugations run substantially parallel to said pivot axis.

9. The exercising appliance of claim 7, wherein said corrugations run substantially perpendicular to said pivot axis.

10. The exercising appliance of claim 7, wherein said confined space is defined by the space between a mattress and a bed and said corrugations are defined on leg means surrounding an opening in said first portion, said mattress bowing into said opening.

11. The exercising appliance of claim 10, wherein said bed includes a box spring and said confined space is defined by the space between said mattress and said box spring.

12. The exercising appliance of claim 1, wherein said spaced retention means includes spaced holes, said third means includes holes formed in said second means and said locating means comprise pin means.

13. The exercising appliance of claim 1, wherein said first and second portions and said bar means are formed by injection molding of styrene plastic.

14. The exercising appliance of claim 1, wherein said bar means includes a core member and a cover member, said core member including a central portion and side portions comprising said third means.

15. The exercising appliance of claim 14, wherein said central portion includes opposed ribs and an upstanding key, said cover member being formed of a resilient material, said cover member being stretched over said central portion with opposed edges thereof lying adjacent opposed sides of said key member.

16. The exercising appliance of claim 1, wherein said second portion further includes a top portion with rows of holes formed therein, indicia corresponding to each hole and pin means fitting in said holes so that specific holes corresponding to specific indicia may be indicated.

17. The exercising appliance of claim 1, wherein said first and second portions are pivotally connected by pin means extending therebetween.

18. An exercising appliance comprising a first portion and a second portion, said first and second portions being pivotally connected to one another at a pivot axis located at respective ends of said portions, said first portion including:

(a) first means adapted to frictionally engage said first portion in a substantially fixed position when said first portion is placed in a confined space; and (b) second means adjacent said pivotally connected end for limiting the movement of said first portion into said confined space to a pre-determined distance;

said second portion including:

(a) guide means on opposed sides thereof;

(b) spaced retention means including spaced holes formed adjacent each guide means; and (c) bar means mounted on said second portion including:

(i) third means interengaging with said guide means to allow slidable movement of said bar means with respect to said guide means;

(ii) fourth means including holes formed in said third means, said fourth means adapted to align with said spaced retention means at pre-determined positions of movement of said bar means; and (iii) pin means adapted to interengage with said spaced retention means and said fourth means to lock said bar means into pre-determined fixed positions;

(iv) said holes formed in said third means, said spaced holes forming said space retention means and said pin means being tapered so that each said pin means frictionally engages one of said spaced holes and said third means holes to retain said bar means in pre-determined spaced fixed positions.

19. The exercising appliance of claim 18, wherein said third means comprise slotted ends of said bar means, each tine of said slotted ends including a hole, said holes in said tines being axially aligned with each other and surrounding one of said spaced holes when aligned therewith.

20. An exercising appliance comprising a first portion and a second portion, said first and second portions being pivotally connected to one another at a pivot axis located at respective ends of said portions, said first portion including:

(a) first means elongated in a first direction assisting in frictionally retaining said first portion in a substantially fixed position when said first portion is placed in a confined space;

(b) second means adjacent said pivotally connected end extending in a second direction substantially perpendicular to said first direction at said first portion end and limiting the movement of said first portion into said confined spaced to a pre-determined distance, said second means further adapted to limit pivotal movement of said first and second portions with respect to one another to an angular displacement therebetween of approximately 90°; and (c) slot means formed at an end opposite said pivotally connected end which forms handle means;

said second portion including:

(a) guide means;

(b) retention means formed in said guide means; and (c) bar means mounted on said second portion including:

(i) third means interengaging with said guide means and allowing slidable engaging movement of said bar means on said guide means with respect to said pivot axis; and (ii) fourth means adapted to interengage with said retention means and said third means to lock said bar means into fixed positions.

* * * * *